US008388250B2

(12) United States Patent
Harden

(10) Patent No.: US 8,388,250 B2
(45) Date of Patent: Mar. 5, 2013

(54) TOOTHPASTE DISPENSING TOOTHBRUSH WITH MOUTHWASH STRIP ROLL COMPARTMENT

(76) Inventor: Vanessa Lynn Harden, Westville, NJ (US)

( * ) Notice: Subject to any disclaimer, the term of this patent is extended or adjusted under 35 U.S.C. 154(b) by 0 days.

(21) Appl. No.: 13/114,922

(22) Filed: May 24, 2011

(65) Prior Publication Data

US 2012/0160261 A1 Jun. 28, 2012

Related U.S. Application Data

(63) Continuation-in-part of application No. 12/976,945, filed on Dec. 22, 2010, now abandoned.

(60) Provisional application No. 61/347,106, filed on May 21, 2010.

(51) Int. Cl.
*A46B 11/04* (2006.01)

(52) U.S. Cl. ..... 401/175; 401/131; 401/194; 401/195; 401/277

(58) Field of Classification Search ..... 401/131, 401/195, 277, 194, 175; 83/649; 116/109, 116/227

See application file for complete search history.

(56) References Cited

U.S. PATENT DOCUMENTS

| | | | | | |
|---|---|---|---|---|---|
| 2,699,889 | A | * | 1/1955 | Johnson | 222/390 |
| 3,101,538 | A | * | 8/1963 | Dewyer | 83/649 |
| 3,738,762 | A | * | 6/1973 | Moore et al. | 401/186 |
| 3,853,134 | A | * | 12/1974 | McCord | 132/309 |
| 4,234,104 | A | * | 11/1980 | Apuzzo et al. | 222/94 |
| 4,821,752 | A | * | 4/1989 | Widlak | 132/309 |
| 4,957,125 | A | * | 9/1990 | Yaneza | 401/195 |
| 5,066,155 | A | * | 11/1991 | English et al. | 401/175 |
| 5,133,980 | A | * | 7/1992 | Ream et al. | 426/115 |
| 5,146,828 | A | * | 9/1992 | Huang et al. | 83/570 |
| 5,199,610 | A | * | 4/1993 | Gagliardi | 222/101 |
| 5,453,644 | A | * | 9/1995 | Yap et al. | 307/116 |
| 5,832,940 | A | * | 11/1998 | Embry et al. | 132/309 |
| 5,888,010 | A | * | 3/1999 | Laux | 401/268 |
| 5,918,996 | A | * | 7/1999 | Coolbaugh | 401/175 |
| 5,927,889 | A | * | 7/1999 | La Flower | 401/268 |
| 5,950,641 | A | * | 9/1999 | Taveras | 132/309 |
| D454,740 | S | * | 3/2002 | Baggott | D6/534 |
| 6,386,779 | B1 | * | 5/2002 | Davis | 401/175 |
| 6,390,103 | B1 | * | 5/2002 | Manso | 132/309 |
| 6,729,789 | B2 | * | 5/2004 | Gordon | 401/278 |
| D492,869 | S | * | 7/2004 | Henry | D6/534 |
| D498,958 | S | * | 11/2004 | Henry | D6/534 |
| 7,004,662 | B1 | * | 2/2006 | Gordon | 401/278 |
| 7,011,467 | B1 | * | 3/2006 | Fiore (the younger) et al. | 401/278 |
| 7,070,354 | B1 | * | 7/2006 | Gutierrez-Caro | 401/277 |
| 7,225,559 | B1 | * | 6/2007 | Padilla | 34/202 |
| D569,150 | S | * | 5/2008 | Vasilev | D6/534 |
| 7,478,960 | B2 | * | 1/2009 | Glover | 401/188 R |
| 7,997,822 | B2 | * | 8/2011 | Rosner et al. | 401/263 |
| 2003/0198503 | A1 | * | 10/2003 | Gordon | 401/278 |
| 2006/0280548 | A1 | * | 12/2006 | Sharpe | 401/269 |

(Continued)

*Primary Examiner* — David Walczak
*Assistant Examiner* — Bradley Oliver
(74) *Attorney, Agent, or Firm* — Sinorica, LLC

(57) ABSTRACT

A toothbrush combined with a toothpaste dispenser with a wall mounted holder. The present invention comprises of a twist knob that is able to push a piston up a toothpaste compartment. The piston creates pressure inside the toothpaste compartment and causes the toothpaste to travel up a main channel. The main channel branches into a plurality of smaller tubes. Each tube has a respective rubber tube dispenser that protrudes and extends from the brush head. The rubber tube dispensers allow the toothpaste to be dispensed on top of the bristles. The toothbrush additionally comprises of a mouthwash strip roll dispensing mechanism positioned in the knob. The present invention additionally comprises of audio and visual indicators to provide users with visual or hearing impairments with a signal notification of toothpaste depletion.

1 Claim, 7 Drawing Sheets

U.S. PATENT DOCUMENTS

2007/0086183 A1* 4/2007 Foster et al. ..... 362/135
2007/0262035 A1* 11/2007 Hoy ..... 211/66
2009/0283651 A1* 11/2009 Vasilev ..... 248/230.7
2011/0024647 A1* 2/2011 Hsu ..... 250/455.11

* cited by examiner

TOOTHPASTE DISPENSING TOOTHBRUSH WITH MOUTHWASH STRIP ROLL COMPARTMENT

The current application is a Continuation in-part of, and claims a priority to the U.S. Provisional Patent application Ser. No. 61/347,106 filed on May 21, 2010 and the U.S. Utility patent application Ser. No. 12/976,945 filed on Dec. 22, 2010 now abandoned.

FIELD OF THE INVENTION

The present invention relates generally to a device that is used to brush teeth while having the ability to dispense toothpaste. More specifically, the toothbrush comprises of a toothpaste compartment that allows users to directly dispense the toothpaste onto the bristles.

BACKGROUND OF THE INVENTION

The morning routine of waking up and brushing teeth is a tedious but necessary process. The morning brush is able to get rid of any bacteria and plaque buildup on one's teeth during the night. However, groggy users in the mornings may accidentally miss the toothbrush when applying the toothpaste onto the bristles. At times, half awaken users can also accidentally squeeze the toothpaste from the tube onto their clothing. The user will generally wet the toothpaste and brush combination under the faucet. The toothpaste will foam when agitated inside the mouth. The present invention aims to simplify the tooth brushing process by allowing users to dispense toothpaste from the toothbrush itself.

Veterans and those in the armed forces who may be handicapped or injured may benefit from the present invention as it makes the process of dispensing toothpaste onto a toothbrush simplified. Whereas traditionally, coordination is required to position the dispensing toothpaste from a tube onto the bristles of a toothbrush, the present invention simply dispenses the toothpaste directly onto the bristles from the toothbrush's internal chamber.

The American Dental Association recommends that a toothbrush be replaced every 90 days. The present invention will have a supply of tooth gel/paste for 90 days and 90 concentrated/perforated mouthwash strips. The invention will not only meet the criteria of the ADA, but the ease of dispensing toothpaste/gel onto the rounded bristles will meet the needs of the handicapped and disabled veterans. Hearing and visually impaired will be able to use the present invention with ease by having an audio/visual sensor to alert the user that the 90 day supply of tooth gel/paste is depleting and a new brush will need to be purchased.

The present invention will provide users convenience in reducing the number of items in their bathrooms. The present invention also prevents users from accidentally missing the toothbrush when applying toothpaste. Another convenience provided by the present invention is that users will not have to worry about losing the cap to the toothpaste tube. The present invention additionally is able to store and dispense mouthwash strip. When the toothpaste supply has neared depletion, the present invention additionally comprises of a visual and audio indicator that is triggered when a sensor is activated.

DETAIL DESCRIPTIONS OF THE INVENTION

Figure 1:
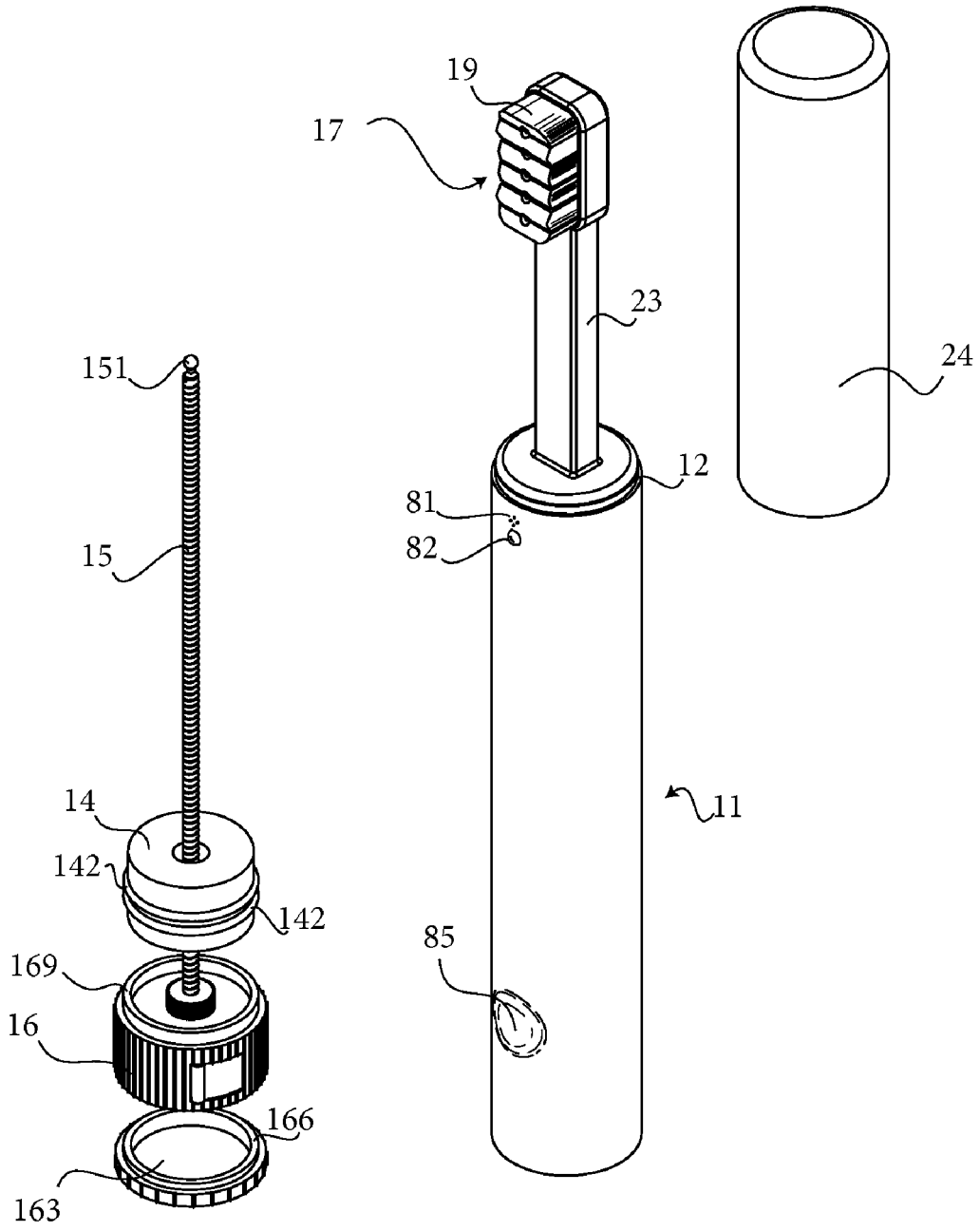
FIG. 1 is an exploded view of the toothbrush of the present invention.

All illustrations of the drawings are for the purpose of describing selected versions of the present invention and are not intended to limit the scope of the present invention.

The American Dental Association recommends that a toothbrush be replaced every 90 days. The present invention will have a supply of tooth gel/paste for 90 days and 90 concentrated/perforated mouthwash strips. The invention will not only meet the criteria of the ADA, but the ease of dispensing toothpaste/gel onto the rounded bristles will meet the needs of the handicapped. Disabled veterans will be able to use the present invention with ease by having an audio/visual sensor to alert the user that the 90 day supply of tooth gel/paste is depleting and a new brush will need to be purchased.

The present invention is a toothbrush 1 that comprises of a handle 11, a brush head 17, and a cover 24. The handle 11 further comprises of a cover snap 12, a toothpaste compartment 13, a piston 14, a threaded member 15, and a knurled knob 16. The handle 11 is the body of the present invention that is able to dispense both toothpaste and mouthwash strips 40. The brush head 17 of the present invention is the component of the present invention that the handle 11 is able to dispense the toothpaste to for convenient brushing of the teeth. The cover 24 comprises of a cover lip 25. The cover 24 is cylindrically shaped hollow component that is able to envelop the brush head 17. The cover 24 attaches to the handle 11 by means of the cover lip 25 engaging the cover snap 12. The cover 24 allows the user to seal the brush head 17 to prevent any drying of the toothpaste. Additionally, the cover 24 prevents and contamination of the brush head 17 from any bacteria. The present invention is readily assembled and packaged when placed in the market. The user of the present invention will not need to assemble the present invention. Instead, the toothbrush will be sold prefilled with tooth gel/paste and mouthwash strips. The user will simply turn then knob to extrude the tooth gel/paste and brush their teeth.

In reference to FIG. 2-3 and FIG. 6-9, the handle 11 is able to store toothpaste by means of the toothpaste compartment 13. The toothpaste compartment 13 is an elongated recessed space that traverses through the handle 11 with the compartment opening positioned on the bottom surface of the handle 11. The toothpaste compartment 13 comprises of a member snap 131. The member snap 131 is positioned on the top surface of the toothpaste compartment 13 in concentric relationship. The member snap 131 is a protruding receiving piece that is able to secure the threaded member 15. The threaded member 15 is a threaded rod concentrically connected to the knurled knob 16. The threaded member 15 has a snap end 151 that is positioned on the end opposite of the knurled knob 16. The snap end 151 is inserted into the member snap 131 to secure the threaded member 15 onto the handle 11. Connected to the threaded member 15 is the piston 14. The piston 14 is a cylindrically shaped piece that comprises of a threaded hole 141 and a sealing edge 142. The piston 14 is the component of the handle 11 that is able to push the toothpaste from the toothpaste compartment 13 to the bristles of the brush head 17. The threaded hole 141 is a hole that traverses through the entire piston 14. The threaded hole 141 is concentrically arranged through the piston 14. The piston 14 is attached to the threaded member 15 by means of inserting the threaded member 15 through the threaded hole 141. The sealing edge 142 is a protruding ring around the side edge of the piston 14. The sealing edge 142 being made of an elastic material is able to seal the seam between the walls of the toothpaste compartment 13 and the piston 14. As the knurled knob 16 is twisted, the threaded member 15 is able to push the piston 14 up the toothpaste compartment 13 and at the same time creating pressure to push the toothpaste out of the toothpaste compartment 13 to the brush head 17. The knurled knob 16 also comprises of an insert ledge 169. The insert ledge 169 allows the knurled knob 16 to be fitted into the opening of the handle 11 leading into the toothpaste compartment 13.

The fit of the insert ledge 169 into the opening allows for a snug fit between the knurled knob 16 and the handle 11 to prevent shifting of the knob. Although the knurled knob 16 is fit to the handle 11, it is still able to rotate allowing the user to dispense toothpaste.

Figure 7:
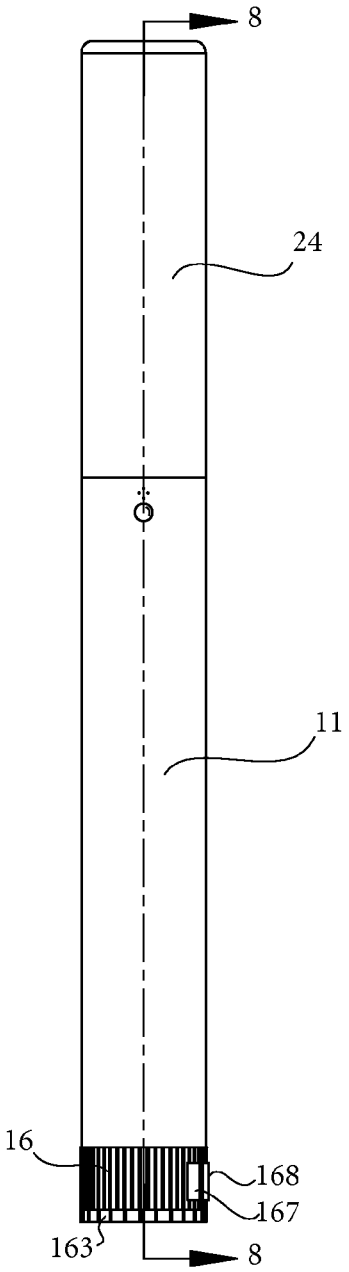
FIG. 7 is a front elevational view of the toothbrush in which a sectional plane is taken and shown in FIG. 7.
Figure 9:
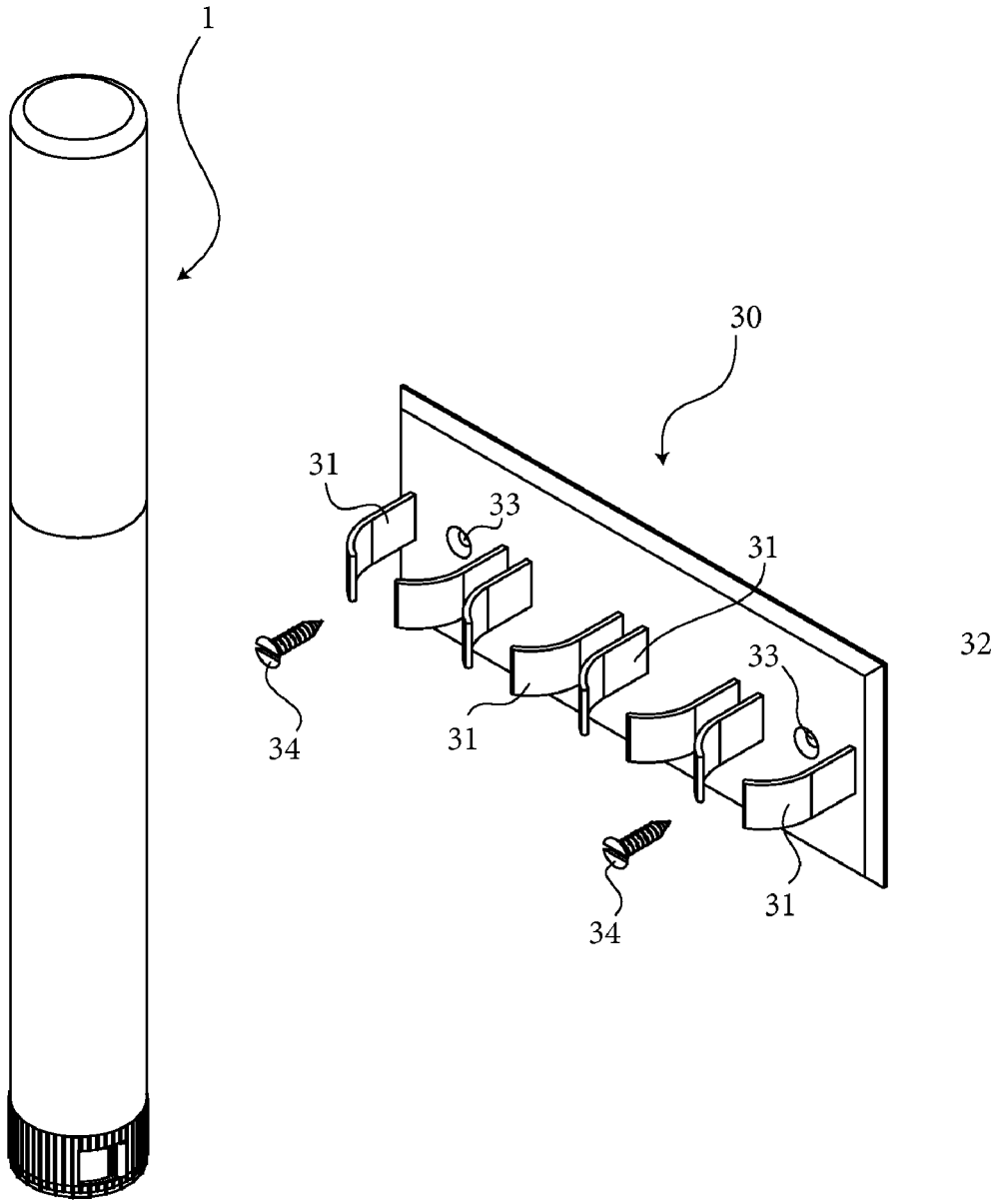
FIG. 9 is a perspective view of the completely assembled toothbrush with the toothbrush holder and the fasteners.

In reference to FIG. 7 and FIG. 9, the brush head 17 comprises of a head face 18, a plurality of bristles 19, a plurality of rubber tube dispensers 20, a main channel 21, a plurality of toothpaste channels 22, and a neck 23. The plurality of bristles 19 protrudes and extends out from the head face 18. The plurality of rubber tube dispensers 20 also protrude and extend out from the head face 18. In the preferred embodiment of the present invention, there are five rubber tube dispensers arranged in a vertical fashion to allow even distribution of toothpaste being dispensed onto the bristles. The neck 23 of the brush head 17 extends the head face 18 from the handle 11. The main channel 21 is a hollow channel that traverses the length of the brush head 17. The plurality of rubber tube dispensers 20 are connected to the toothpaste compartment 13 by means of the plurality of toothpaste channels 22 and the main channel 21. The plurality of rubber tubes are first connected to the main channel 21 by the plurality of toothpaste channels 22. The plurality of toothpaste channels 22 are then connected to the toothpaste compartment 13 by means of the main channel 21. The plurality of rubber tube dispensers 20 allow the toothpaste to easily dispense to the bristles. In case of pressure buildup inside the toothpaste compartment 13, the plurality of rubber tube dispensers 20 are able to expand and release the toothpaste to relieve the pressure accordingly. Additionally, the plurality of rubber tube dispensers 20 are flexible and cone shaped lying underneath the bristles to prevent interference with the brushing of the user's teeth. In the preferred embodiment of the present invention, the plurality of rubber tube dispensers 20 is conically shaped with an opening at the tip. However, in other embodiments of the present invention the plurality of rubber tube dispensers 20 can be other shapes including tetrahedrons, cylinders, rectangular, or any other shape suitable for equally dispensing toothpaste while doubling as an effective bristle for scrubbing teeth.

Figure 2:
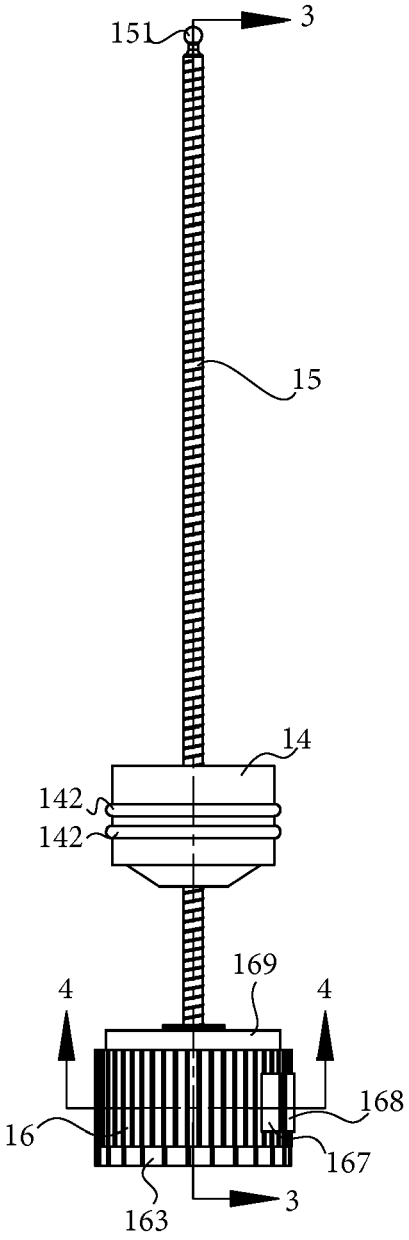
FIG. 2 is a right side elevational view of the knurled knob and the threaded member in which a sectional plane is taken and shown in FIG. 3.
Figure 3:
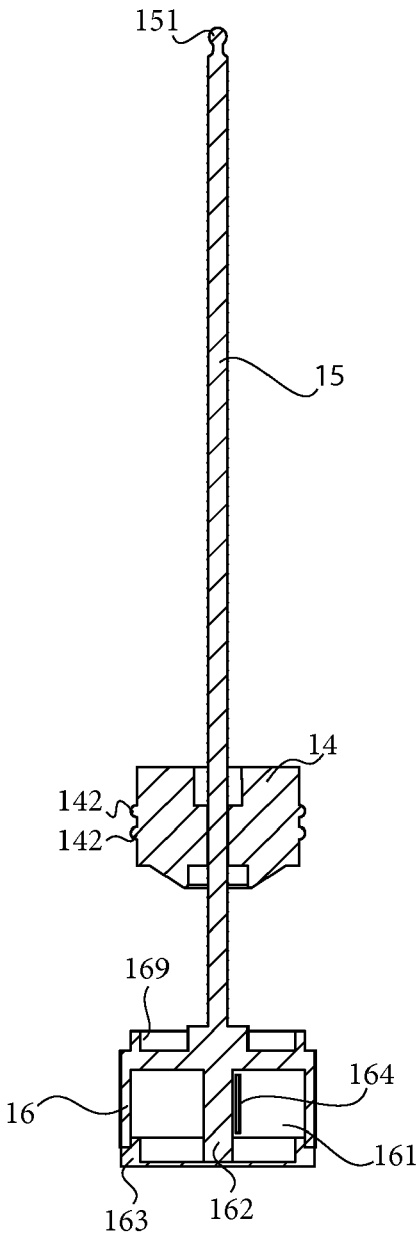
FIG. 3 is a front sectional view of the knurled knob and the threaded member.
Figure 4:
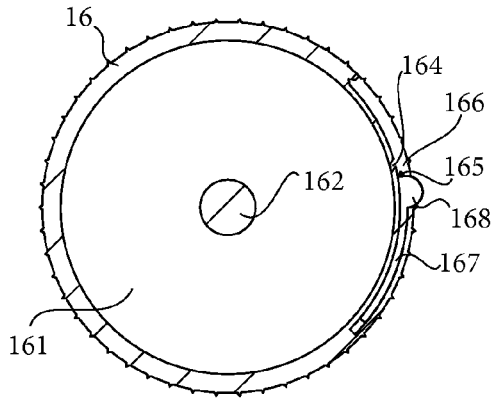
FIG. 4 is a bottom plan view showing the cross section of the knurled knob. The diagram depicts the slide door mechanism that allows users to access the mouthwash strips.
Figure 5:
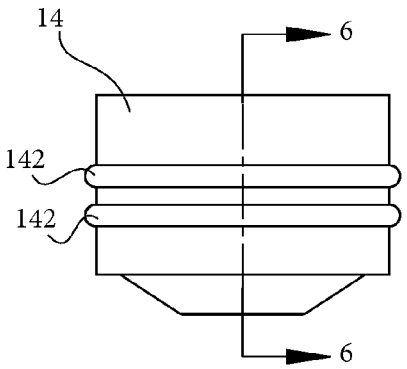
FIG. 5 is a right side elevational view of the piston in which a plane is taken and shown in FIG. 6.
Figure 6:
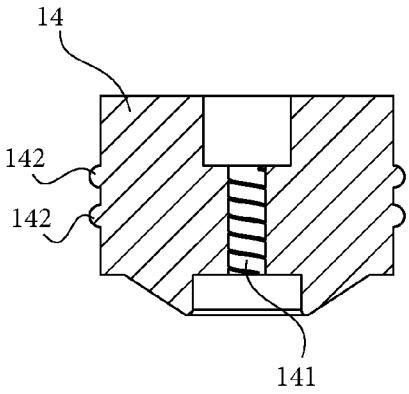
FIG. 6 is a front sectional view of the piston.
Figure 11:
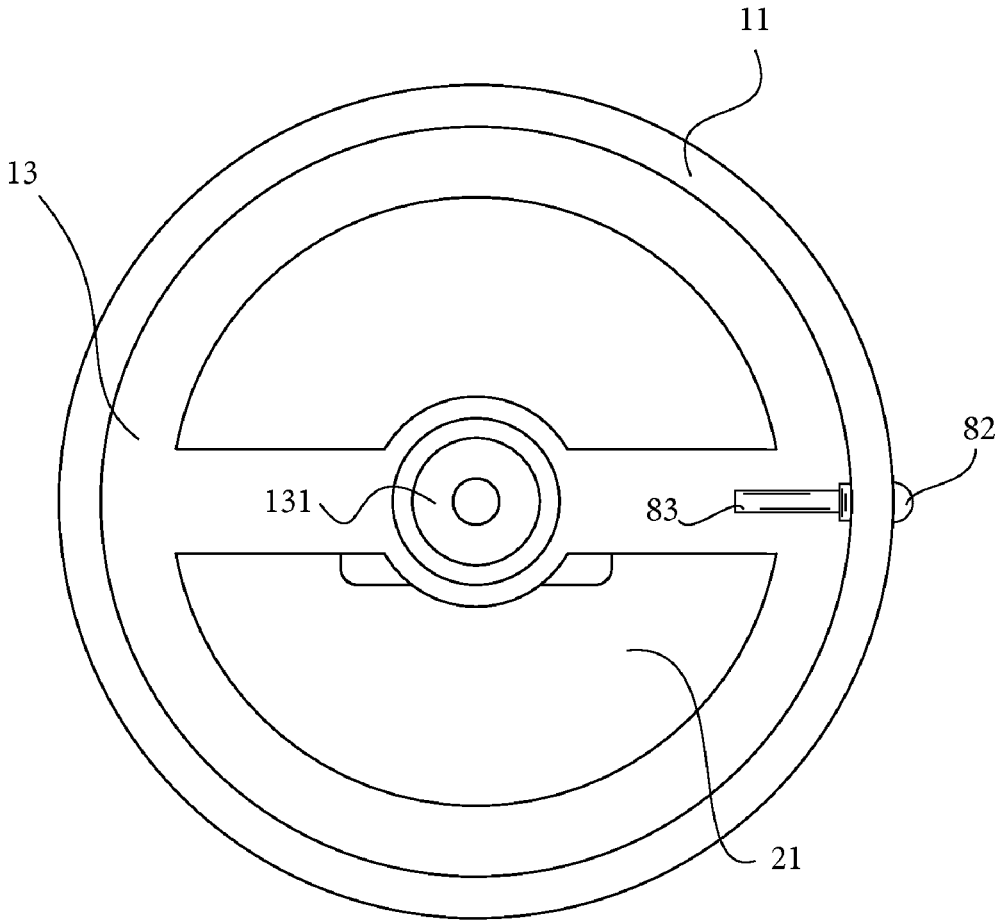
FIG. 11 is a bottom plan view of the toothpaste compartment showing the holes leading into the main channel.

In reference to FIG. 2-3 and FIG. 11, knurled knob 16 additionally comprises of a roll compartment 161, a roll axle 162, a roll cover 163, a roll hole 164, a slide door slot 166, and a slide door 167. The roll compartment 161 is a recessed space on the bottom of the knurled knob 16 opposite of the threaded member 15. The roll axle 162 protrudes from the center of the roll compartment 161 and serves as an axle that allows a roll of mouthwash strips 40 to pivot about it. To contain the roll of mouthwash strips 40 within the roll compartment 161, the user is able to seal the roll compartment 161 with the roll cover 163. In the preferred embodiment of the present invention, the roll cover 163 is permanently fastened to the knurled knob 16 by means of a sealing adhesive. Positioned on the knurled knob 16 is the slide door slot 166. The slide door slot 166 is a space in the walls of the knurled knob 16 that can fit the slide door 167. The slide door 167 being positioned inside the slide door slot 166 is able to slide open or closed to reveal and conceal the roll hole 164. To slide the slide door 167 open and closed, the slide door 167 further comprises of a handle lip 168. The handle lip 168 is positioned on a first side of the slide door 167 that is accessible to the user. The roll hole 164 is an opening positioned on the slide door slot 166 leads into the roll compartment 161. The roll hole 164 also allows the user to draw a segment strip of the mouthwash strip from the roll compartment 161. While the user is drawing the mouthwash strip from the roll hole 164, the roll of mouthwash strips 40 will unravel about the roll axle 162. The slide door slot 166 provides an arc with a suitable length to pinch and hold the mouthwash strips 40 of predetermined lengths. The roll of mouthwash strips 40 provides a supply of ninety strips for ninety days. The predetermined lengths of the mouthwash strips 40 on the roll have perforations 41 for easy tearing. This will prevent the strip from retracting back into the roll compartment 161 and becoming inaccessible from the roll hole 164. In the preferred embodiment of the present invention, the roll cover 163 is able to fasten onto the knurled knob 16 by means of a threaded ledge. In other embodiments of the present invention the method of fastening the roll cover 163 can be a snap.

Figure 8:
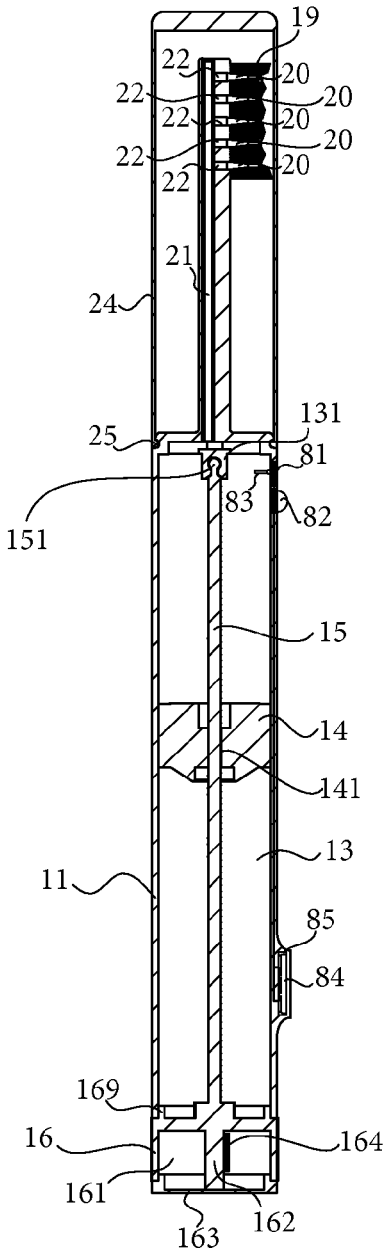
FIG. 8 is a left side sectional view of the toothbrush.

In reference to FIG. 8 and FIG. 11, the handle of the present invention additionally comprises an empty audio indicator 81, an empty visual indicator 82, an empty switch 83, a battery 84, and a battery compartment 85. The empty audio indicator 81 and the empty visual indicator 82 are able to provide users that have visual impairment or hearing impairment with a signal indicating the imminent depletion of toothpaste. The empty visual indicator 82 and the empty audio indicator 81 are positioned on the exterior surface of the handle adjacent to the cover snap. To trigger the empty visual indicator 82 and the empty audio indicator 81, the handle makes use of the empty switch 83. The empty switch 83 is positioned on the inner surface of the handle within the toothpaste compartment adjacent to the top surface. The empty switch 83 is a lever type switch that is triggered as the piston is pushed towards the top surface of the toothpaste compartment 13. To power the empty visual indicator 82 and the empty audio indicator 81, the handle makes us of the battery 84. The battery compartment 85 is a cavity positioned in the handle 11. The battery 84 is secured and stored in the battery compartment 85 to power the empty audio indicator 81 and the empty visual indicator 82. In the preferred embodiment of the invention, as the tooth brush is disposable once the toothpaste is completely depleted, the battery 84 is a very small battery 84 able to excite the empty audio indicator 81 and the empty visual indicator 82. In the preferred embodiment of the present invention, the empty audio indicator 81 is a mini-speaker that emits a beeping sound when the empty switch 83 is triggered. The empty visual indicator 82 is a small LED that blinks when the empty switch 83 is triggered. However, while the empty switch 83 is not triggered, the empty audio indicator 81 and the empty visual indicator 82 are not powered. The empty audio indicator 81 and the empty visual indicator 82 are connected to the battery 84 by means of the empty switch 83 and wires. When the piston triggers the empty switch 83, the circuit from the battery 84 to the empty audio indicator 81 and the empty visual indicator 82 is completed to indicate the imminent depletion of the toothpaste. The empty audio indicator and the empty visual indicator will indicate to the user that there are only a few uses of toothpaste supply remaining before depletion. By triggering the empty audio indicator and the empty visual indicator prior to the complete depletion of the toothpaste supply, the user is provided with time to purchase a new prefilled toothbrush.

Figure 10:
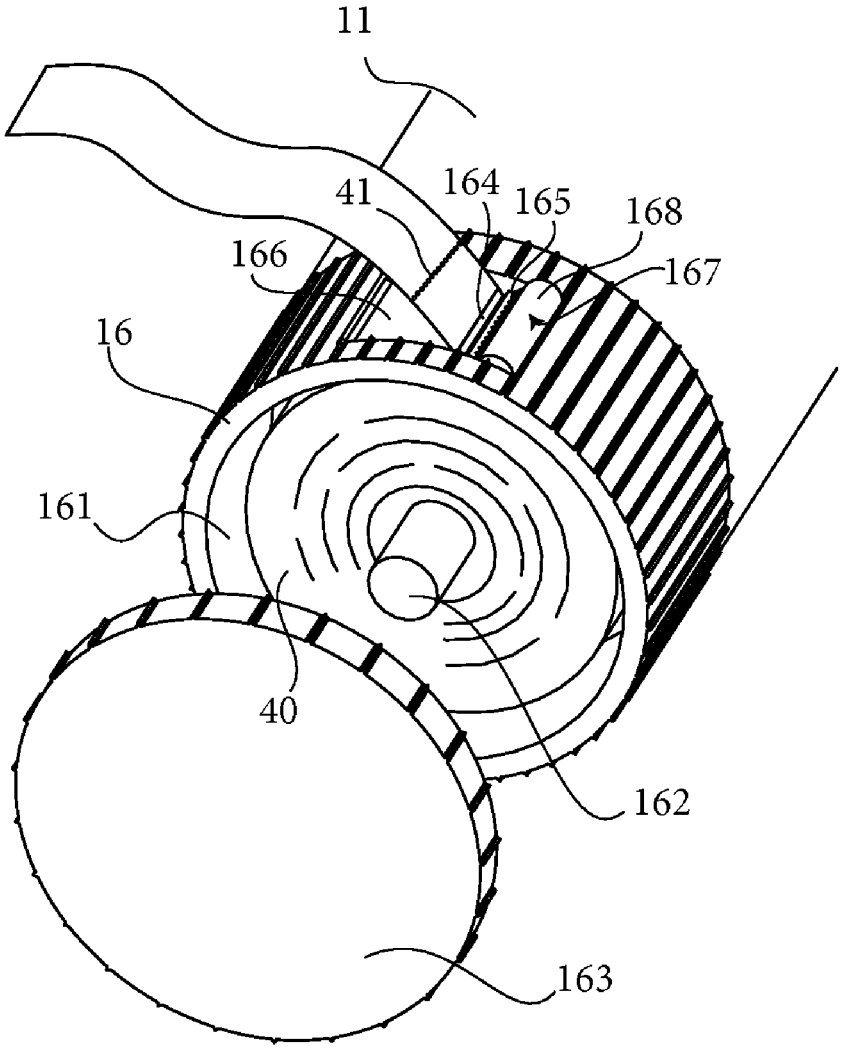
FIG. 10 is a bottom view of the knurled knob showing a roll of mouthwash strip being dispensed.

In reference to FIG. 10, the present invention also comprises of a toothbrush holder 30. The toothbrush holder 30 comprises of a plurality of U-clamps 31, a mount 32, fastener holes 33, and fasteners 34. The toothbrush holder 30 is able fastened onto a wall by means of the mount 32. The fastener holes 33 are holes positioned on the mount 32 traversing through the entire body. The user is able to fasten the toothbrush holder 30 onto a wall by inserting a fastener 34 through the fastener holes 33 and into a wall. The fasteners 34 can by any type of fastener including screws, nails, bolts, pins, or any other suitable types of fasteners. The plurality of U-clamps 31 protrudes from the mount 32 and allows users to hold the toothbrush 1 against the wall for convenient storage and access.

For the present invention to properly push the toothpaste up the handle and through the plurality of rubber tubes, the piston 14 is connected to the threaded member 15. The piston 14 is attached and vertically fixed to the threaded member 15. To assemble the knurled knob 16 and the threaded member 15 to the handle 11, the threaded member 15 is aligned in a concentric and parallel fashion to the handle 11 to ensure the snap end 151 of the threaded member 15 engages the member snap 131. When the snap end 151 engages the member snap 131, the insert ledge 169 of the knurled knob 16 will also engage the opening of the handle 11 and the toothbrush 1 is ready to use.

In the preferred embodiment of the present invention, the toothbrush 1 is a disposable toothbrush manufactured with pre-filled toothpaste and mouthwash strips 40. The toothbrush 1 will have a ninety day supply of toothpaste and mouthwash strips 40. In the preferred embodiment of the present invention, the piston 14 is originally positioned directly on top of the knurled knob 16 to provide the space in the toothpaste compartment 13 to store ninety days worth of toothpaste. Additionally, in the preferred embodiment of the present invention, the roll of mouthwash strips 40 is sealed inside the roll compartment 161. Once the toothpaste stored in the toothpaste compartment 13 is depleted, the user will have used the toothbrush 1 for about ninety days. To use the present invention, the user will simply twist the knurled knob 16 to push the piston 14 up the toothpaste compartment 13. As the piston 14 is pushed up the toothpaste compartment 13, pressure builds up and pushes the toothpaste out of the toothpaste compartment 13 through the main channel 21, the plurality of toothpaste channels 22, and the plurality of rubber tube dispensers 20. On the side of the knurled knob 16, the user is able to dispense the mouthwash strips 40 from the roll hole 164. The user can seal the roll hole 164 by means of the slide door 167. The slide door 167 also acts as a clamping mechanism to hold the mouthwash roll from rolling into the sealed roll compartment 161 and becoming inaccessible. The American Dental Association (ADA) recommends that tooth brushes be replaced every 90 days. Therefore in the preferred embodiment of the present invention, a 90 day supply of gel and strips are included with each disposable toothbrush.

Although the invention has been explained in relation to its preferred embodiment, it is to be understood that many other possible modifications and variations can be made without departing from the spirit and scope of the invention as hereinafter claimed.

What is claimed is:

1. A toothpaste dispensing toothbrush with mouthwash strip roll compartment comprises, a toothbrush;

a toothbrush holder;

a roll of mouthwash strip;

the toothbrush comprises of a handle, a brush head, and a cover;

the tooth brush holder comprises of a plurality of U-clamps, a mount, a plurality of fastener holes, and a plurality of fasteners;

the handle comprises of a cover snap, a toothpaste compartment, a piston, a threaded member, a knurled knob, an empty audio indicator, an empty visual indicator, an empty switch, a battery, and a battery compartment;

the brush head comprises of a head face, a plurality of bristles, a plurality of rubber tube dispensers, a main channel, a plurality of toothpaste channels, and a neck;

the brush head being extended from the handle;

the cover comprises of a cover lip;

the brush head being enveloped by the cover by means of the cover lip engaging to the cover snap;

the toothpaste compartment being an elongated recessed space traversing the handle;

the toothpaste compartment comprises of a member snap;

the member snap being positioned on a top surface of the toothpaste compartment;

the empty switch being a lever switch positioned in the toothpaste compartment adjacent to the top surface;

the empty audio indicator being positioned adjacent to the cover snap;

the empty visual indicator being positioned adjacent to the cover snap;

the battery compartment being a cavity positioned within the handle;

the battery being positioned in the battery compartment;

the empty audio indicator and the empty visual indicator being connected to the battery by the empty switch by wires;

the piston being cylindrically shaped;

the piston being concentrically positioned in the toothpaste compartment;

the piston comprises of a threaded hole, and a sealing edge;

the knurled knob comprises of a roll compartment, a roll axle, a roll cover, a roll hole, a slide door slot, and a slide door;

the slide door comprises of a handle lip;

the roll cover comprises of a threaded ledge;

the threaded member being concentrically connected to the knurled knob;

the threaded member having a snap end opposite of the knurled knob;

the piston being attached to the threaded member by means of inserting the threaded member through the threaded hole;

the snap end being inserted into the member snap;
the threaded hole traversing in concentric relationship completely through the piston;
the sealing edge being peripherally attached the piston;
the roll compartment being a cylindrical recessed space positioned on knurled knob opposite of the threaded member;
the roll axle being extended inside the roll compartment in concentric relationship;
the roll cover being fastened to knurled knob sealing the roll compartment by means of the threaded ledge;
the slide door slot being positioned on the knurled knob;
the slide door being positioned in the slide door slot;
the handle lip being positioned on a first side of the slide door;
the roll hole being positioned on the slide door slot leading into the roll compartment;
the roll of mouthwash strip comprises of plurality of perforations;
the roll of mouthwash strip being positioned in the roll compartment;
the knurled knob having an insert ledge;
the insert ledge being concentrically fitted to an opening on the handle leading into the toothpaste compartment;
the plurality of bristles being protruded and extended from the head face;
the plurality of rubber tube dispensers being protruded and extended from the head face;
the neck extending the brush head from the handle;
the main channel being a hollow channel traversing the brush head;
the plurality of toothpaste channels being connected to the toothpaste compartment by the main channel;
the plurality of rubber tube dispensers being connected to the toothpaste compartment by the plurality of toothpaste channels;
the plurality of bristles being positioned around the plurality of rubber tube dispensers;
the head face having a larger width than the neck;
the mount being rectangular shaped;
the plurality of U-clamps protruding from the mount;
the fastener holes being positioned on and traversing through the mount;
the fasteners being inserted through the fastener holes; and
the toothbrush being held by the plurality of U-clamps.

* * * * *